US011382381B2

(12) United States Patent
Simon

(10) Patent No.: US 11,382,381 B2
(45) Date of Patent: Jul. 12, 2022

(54) STRUCTURAL ARRANGEMENT OF UPPERS ON SANDALS

(71) Applicant: TESS INDÚSTRIA E COMÉRCIO LTDA. [BR/BR], Campina Grande (BR)

(72) Inventor: Peter Simon, Big Sur, CA (US)

(73) Assignee: Tess Indústria e Comércio Ltda., Campina Grande (BR)

( * ) Notice: Subject to any disclaimer, the term of this patent is extended or adjusted under 35 U.S.C. 154(b) by 176 days.

(21) Appl. No.: 16/968,653

(22) PCT Filed: Feb. 7, 2019

(86) PCT No.: PCT/BR2019/050035

§ 371 (c)(1),
(2) Date: Aug. 10, 2020

(87) PCT Pub. No.: WO2019/153063

PCT Pub. Date: Aug. 15, 2019

(65) Prior Publication Data

US 2020/0405004 A1 Dec. 31, 2020

(30) Foreign Application Priority Data

Feb. 8, 2018 (BR) ..... 202018002676-9

(51) Int. Cl.
*A43B 3/12* (2006.01)

(52) U.S. Cl.
CPC ..... *A43B 3/122* (2013.01); *A43B 3/126* (2013.01)

(58) Field of Classification Search
CPC ..... A43B 3/122; A43B 3/126
(Continued)

(56) References Cited

U.S. PATENT DOCUMENTS 3,553,754 A * 1/1971 Mendelsohn ..... A43B 3/103 12/146 S
3,890,725 A * 6/1975 Lea ..... A43B 3/244 36/11.5

(Continued)

FOREIGN PATENT DOCUMENTS

BR PI0600995 A 11/2007
BR PI0604324 A 6/2008

(Continued)

OTHER PUBLICATIONS

English translation of International Search Report received in related PCT application No. PCT/BR2019/050035, dated Apr. 10, 2019; 3 pages.

(Continued)

*Primary Examiner* — Marie D Bays
(74) *Attorney, Agent, or Firm* — Greenberg Traurig, LLP

(57) ABSTRACT

The utility model relates to a structural arrangement for attaching flexible uppers to sandals such as flip-flops, consisting of an upper (2) comprising three longitudinal straps (7, 8 and 9) provided with, in the most distal regions thereof, an upper protuberance (10) in contact with an upper surface (5) of a sole (1), a lower protuberance (11) in contact with a lower surface (6) of said sole (1), and a hollow space (12) that passes through cavities (4) in the sole (1) and receives a stopper (3) made of rigid plastic, said stopper having both a region with a smaller diameter (13) and a region with a larger diameter (14), the latter covering the lower recess (11) of the most distal end of the upper (2), as well as a central hole (15) that connects the inside of the hollow space to the outside environment.

20 Claims, 15 Drawing Sheets

(58) Field of Classification Search
USPC ..... 36/11.5
See application file for complete search history.

(56) References Cited

U.S. PATENT DOCUMENTS

| | | | | |
|---|---|---|---|---|
| 4,864,736 | A * | 9/1989 | Bierk | A43B 3/106 36/137 |
| 7,694,436 | B2 * | 4/2010 | Mullen | A43B 3/103 12/142 Q |
| 9,072,338 | B1 * | 7/2015 | Kostecky | A43B 3/103 |
| 9,078,487 | B2 * | 7/2015 | Hillyer | B29D 35/126 |
| 9,380,836 | B1 * | 7/2016 | Vigil | A43B 3/122 |
| 2008/0086825 | A1 * | 4/2008 | Mullen | A43B 3/103 12/142 Q |
| 2010/0212184 | A1 * | 8/2010 | Rudd, Jr. | A43B 3/24 36/11.5 |
| 2012/0285046 | A1 * | 11/2012 | Chapin | A43B 3/12 12/142 S |
| 2017/0135436 | A1 | 5/2017 | Munro et al. | |
| 2017/0258174 | A1 * | 9/2017 | Williams | A43B 3/128 |

FOREIGN PATENT DOCUMENTS

| | | | |
|---|---|---|---|
| BR | PI1000911 | A2 | 1/2012 |
| BR | 202012019252 | U2 | 2/2015 |
| CN | 102595948 | A | 7/2012 |
| FR | 2874794 | A1 | 3/2006 |
| WO | 2010058262 | A2 | 5/2010 |

OTHER PUBLICATIONS

English translation of Written Opinion received in related PCT application No. PCT/BR2019/050035, dated Jan. 10, 2019; 6 pages.

* cited by examiner

STRUCTURAL ARRANGEMENT OF UPPERS ON SANDALS

CROSS-REFERENCE TO RELATED APPLICATION(S) INFORMATION

This application is a 371 U.S. National Stage filing of International application No. PCT/BR2019/050035, filed Feb. 7, 2019, published as WO2019/153063A1, and claims benefit/priority of Brazilian priority application No. 202018002676-9, filed Feb. 8, 2018, published as BR202018002676-9-U2 and -Y1, all of which are incorporated herein by reference in entirety by reference and by attachment.

TECHNICAL FIELD OF THE UTILITY MODEL

The present utility model refers to a structural arrangement for attaching uppers on flexible soles of sandals, more specifically to a mechanism for the double fitting of uppers on flexible soles of sandals (flip-flop sandals).

PRIOR ART TECHNIQUE

Flip-flop sandals have a conventional construction consisting of an upper containing a central cylindrical longitudinal strap that attaches to the sole between the first toe (hallux) and the second toe, while two other cylindrical longitudinal straps extend laterally from the central strap, surrounding the user's feet, and attaching to both sides of the sandal. Some models may show differentiation in the places where the upper straps are attached, but the wrapping structure of the user's feet remains fundamentally the same.

This construction allows the sandal to remain attached to the user's feet when moving, such as walking, maintaining an upper traction force between the user's instep and the sole of the sandal. Thus, the greatest friction and wear caused by movement are concentrated on the user's instep—causing the manufacture of uppers in rubberized and flexible materials in order to reduce friction and irritation with human skin—and in the three fitting points of the upper to the sole of the sandal, namely between the hallux and the second toe and on both sides of the feet.

The problem with this concept is that its construction is fragile when the user's movement is intense. In the face of a run, for example, the traction shown at the three points of attachment to the sole is too high, causing the disengagement of the upper from the sole—a situation in which the user needs to stop and re-fit it, forcing the entry and making the structure as a whole even more fragile—or permanently damaging the structure—either due to the damage to the sole that tears and can no longer properly attach the upper or due to the upper partition, which no longer has one or more of the three attachment structures to the sole of the sandal.

Faced with this problem, some solutions have been proposed and can be seen in the prior art. Document PI 1000911-6 describes a device for attaching an upper to the sole of a shoe such as a flip-flop sandal, wherein the upper has a plastic hitch projection with a conically shaped end and a cylindrical shaft with a diameter smaller than the base of the cone. This construct allows easy insertion of the upper to the sole while making it difficult to remove it. However, a conical projection of the fitting ends does not offer greater resistance to traction promoted by intense movements and such construct remains fragile in such situations.

Document MU 6801346 discloses the fragility problem of the mechanism for attaching the upper to the sole of flip-flop sandals and presents one simple solution: the duplication of attachment structures of the side longitudinal strap of the upper. Thus, the upper now has five attachment structures, one between the hallux and the second toe, and two on each side of the user's foot. To increase the resistance of the upper to intense movements, however, two attachment structures of each side longitudinal strap of the upper are necessary, and they need to be wider to obtain a larger contact surface and, consequently, generate friction with the user's instep. However, the problem with this design is that, in the face of prolonged intense movements, the user feels uncomfortable due to the wider uppers and the excessive number of attachment structures.

Document PI 0604324-0 shows a fitting structure of the upper to the sole of the flip-flop sandals with threaded bushings containing an adhesive substance, in which the terminal attachment component is threaded. This construct, in addition to presenting higher production costs for the upper (due to the threaded structure, and an adhesive substance), does not provide greater resistance to the assembly. Somehow, it is possible to affirm that the problem with such a construct is the decrease of the resistance of the assembly in the long term, due to the natural wear of the integral parts during the continuous processes of changing the uppers.

Document PI 0921316-3 shows a double system for attaching the upper to the sole in a single structure, keeping one attachment region at the bottom part of the sole (in contact with the ground), and one in the upper part. Both the structures are maintained by the difference of diameter of the attachment element in relation to the hole where said element is fitted in the sole. The problem with this construct is the difficulty of keeping the fitting elements connected among them. In this way, the attachment to the user's foot is relatively weak since the instep is not properly wrapped, allowing the entire sandal to leave the user's foot in intense movements.

In light of the prior art documents presented and the problems mentioned, the present utility model presents a structural arrangement of flip-flop sandals, wherein the upper remains firmly in contact with the user's instep and has attachment structures to the sole, allowing the upper to firmly adhere to it, and providing the realization of intense movements by the user, such as race, without the detachment of the upper or leave the user's foot.

OBJECTIVES OF THE UTILITY MODEL

One of the objectives of the present utility model is to provide a structural arrangement for attaching upper to the soles of flip-flop sandals in order to ensure that the upper does not come loose during intense user movements.

Another objective of the present utility model is to provide an upper for flip-flop sandals that are comfortable and firmly suited to the user's instep without coming loose during intense movements.

A third objective of the present utility model is to provide an attachment mechanism of upper to the sole of flip-flop sandals that is functional and of easy production.

The present utility model allows the practical construction, and without extra costs, of flip-flop sandals that remains in firm contact with the user's instep and has attachment structures to the sole, allowing the upper to firmly adhere to it, and providing the realization of intense movements by the user, such as race, without the concern of the detachment of the upper or leave the user's feet.

SUMMARY OF UTILITY MODEL

The objectives of the present utility model are achieved through a structural arrangement with double fitting, wherein the upper straps (containing hollow spaces at their ends) pass through the upper surface of the flexible sole of the sandal, which contains cavities, until the bottom surface, where they find stopper that fit them. Such stoppers have pins for attaching the upper and a region of larger diameter than the cavity in the sole, securely fastening the upper.

The flexible sole of the sandal has three cavities that pass through its entire dimension, communicating the upper part (which is in contact with the user's feet) with the lower part (which is in contact with the ground).

The upper is a unique flexible structure and has three attaching ends—between the hallux and the second toe, as well as on the sides of the user's foot. Each end of the upper has small protuberances in contact with both upper and lower surfaces of the flexible sole in order to increase the grip and a hollow space in the most distal region that passes through the cavities of the flexible sole and fits tightly to the stopper.

Stoppers are rigid plastic elements that have a central pin-shaped structure and fit into the hollow spaces at ends of the upper. As the stoppers have a diameter much larger than the diameter of the hollow space, they overlap the lower protuberances and are firmly attached to the bottom of the sole.

The proposed structural arrangement, therefore, presents a first resistance to the removal of the upper by the lower and upper protuberances thereof, and a second resistance, due to the rigid plastic stopper that keeps the upper attached through the fitting to the stoppers and the bottom sole. The present construction ensures that the traction force made by intense movements of the user is supported and distributed by the assembly of parts of the fitting mechanism, causing the force that pulls the upper upwards during the movement to be counterbalanced by the downwards force of the rigid plastic stoppers.

DESCRIPTION OF THE FIGURES

In the following, the present utility model is described in more detail regarding the drawings.

DETAILED DESCRIPTION OF THE UTILITY MODEL

The object of the present utility model is preferably manufactured in plastic with characteristics such as flexibility and high durability, which allow its use for a long time. However, any other materials of compatible durability and flexibility can be applied, such as vegetable fibers. Likewise, other upper shapes are included in the scope of protection of the object of this utility model, since the functionality of the upper attachment mechanism remains unaffected.

Additionally, the proposed structural arrangement should not be limited to just flip-flop sandals, since the stopper exchange is possible in other upper variations.

Figure 1:
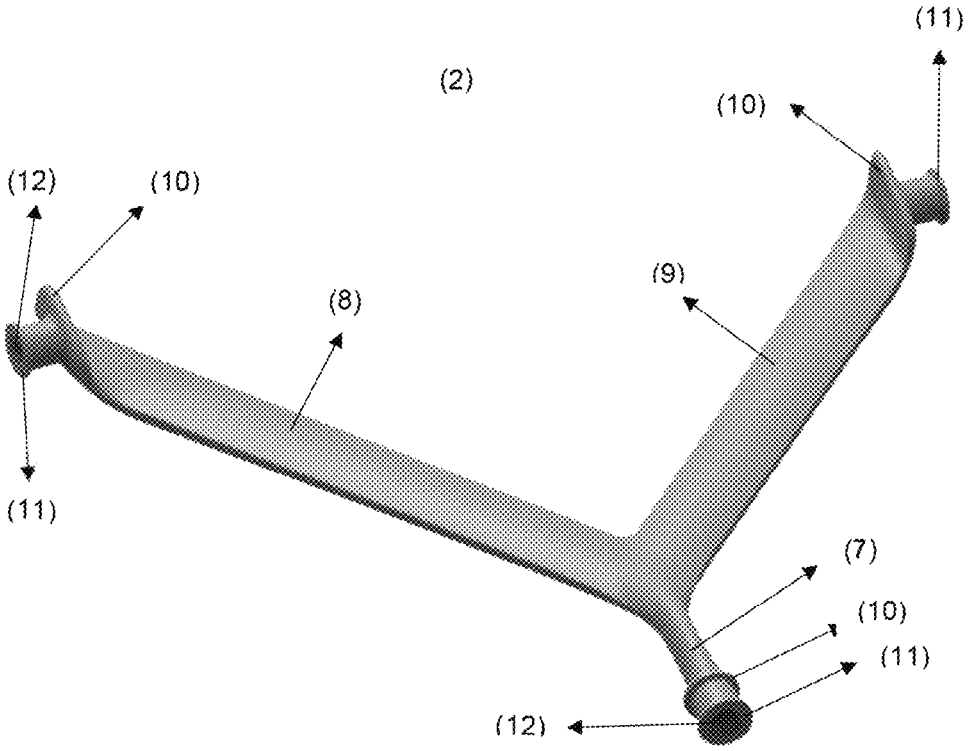
FIG. 1 is a top perspective view of the upper.
Figure 2:
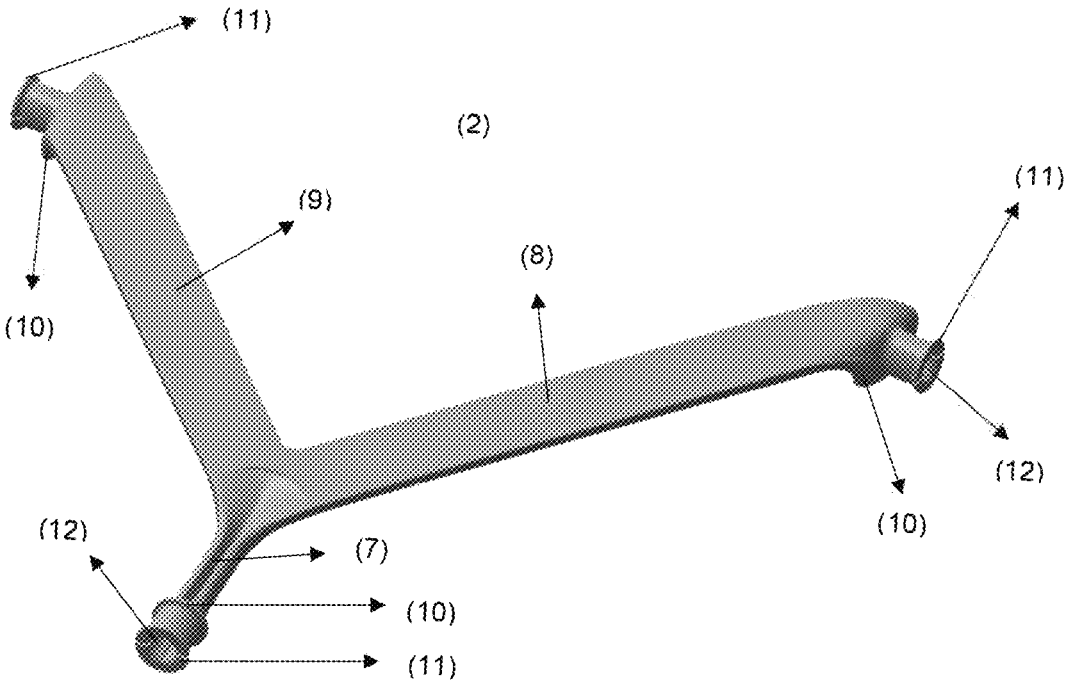
FIG. 2 is a top view of the upper.
Figure 3:
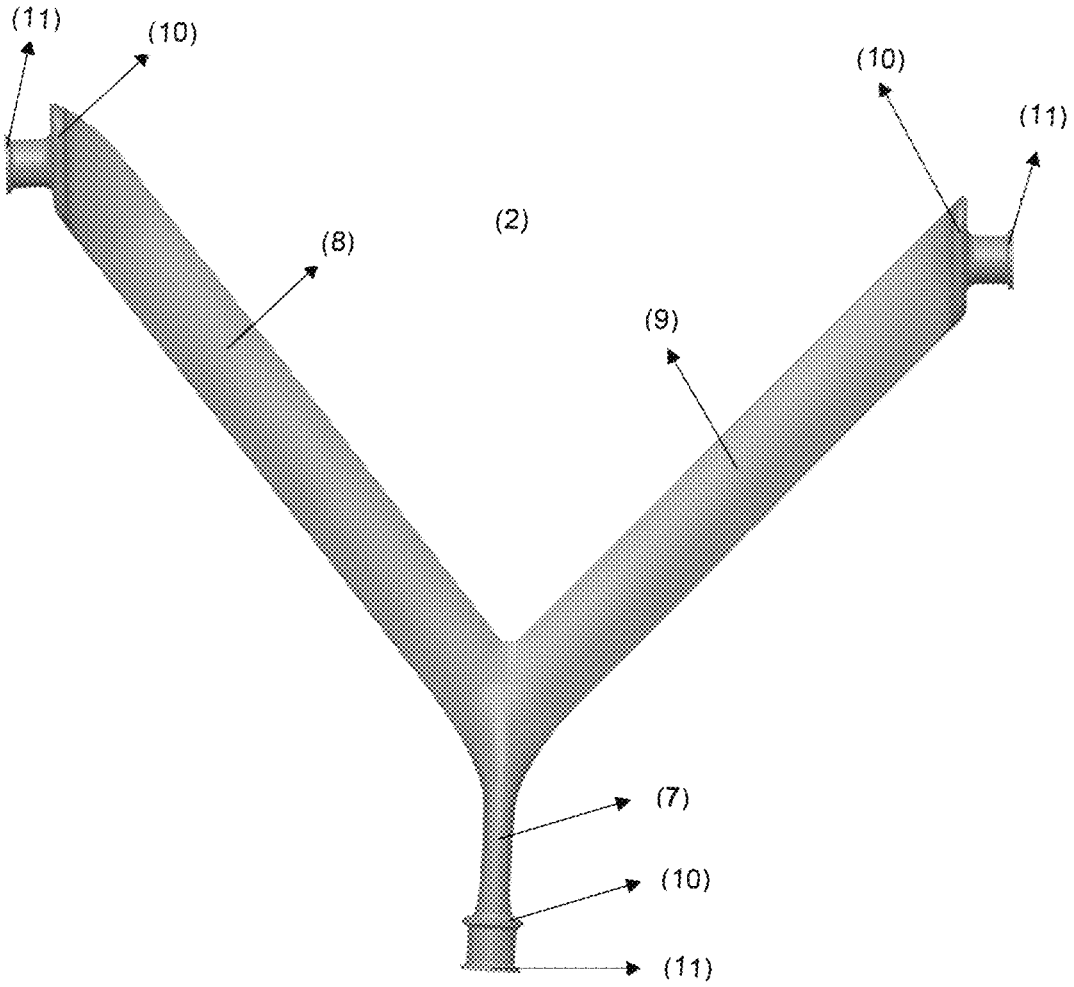
FIG. 3 is a bottom view of the upper.
Figure 4:
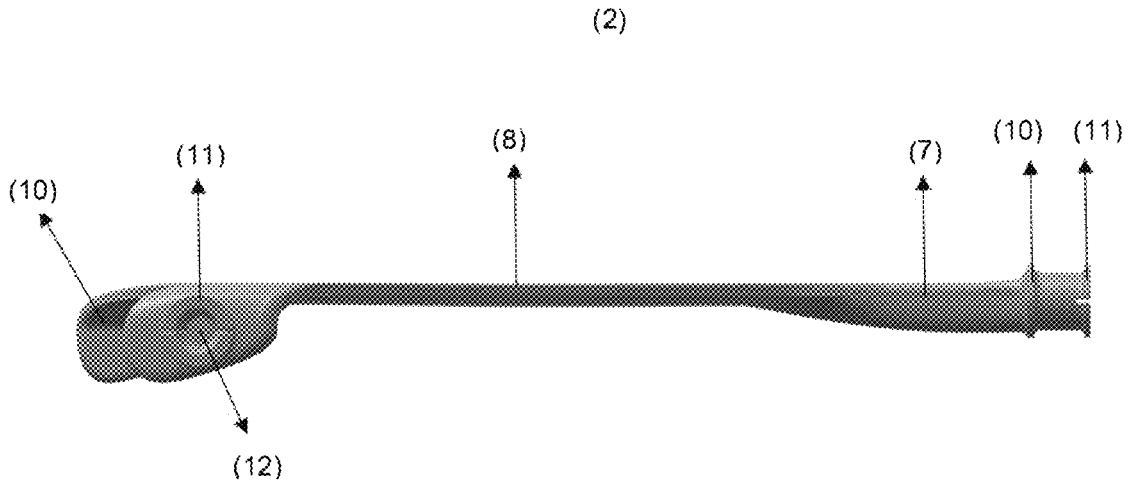
FIG. 4 is a right side view of the upper.
Figure 5:
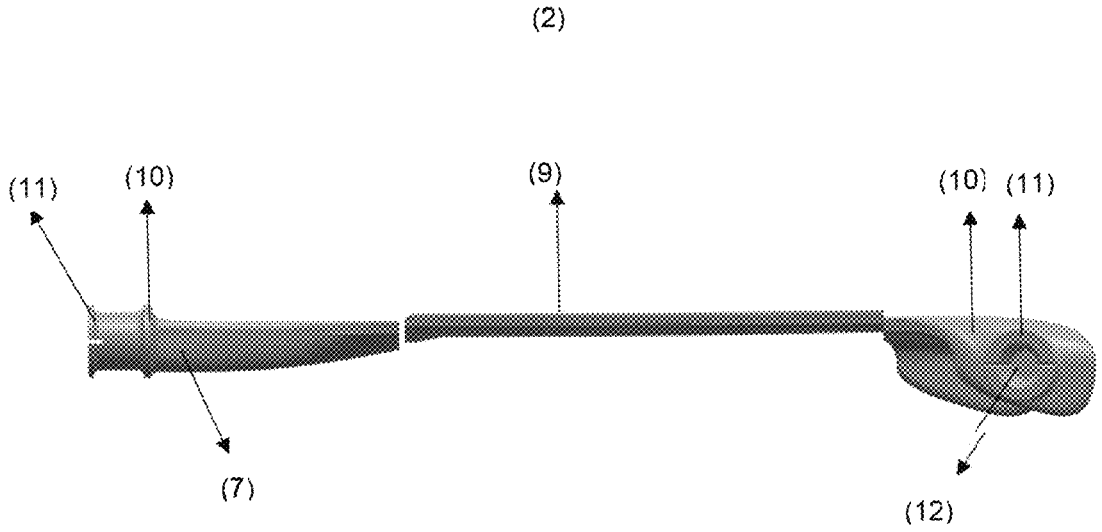
FIG. 5 is a left side view of the upper.

Referring to the above-mentioned figures and according to FIG. 1, the present utility model comprises a flexible Y-shaped upper (2), equipped with three longitudinal straps, the main strap being cylindrical in shape (7) positioned between the hallux and the second toe, and two other side cylindrical straps starting from the main strap, one covering the right side (8) and the other covering the left side (9) of the user's feet.

Figure 13:
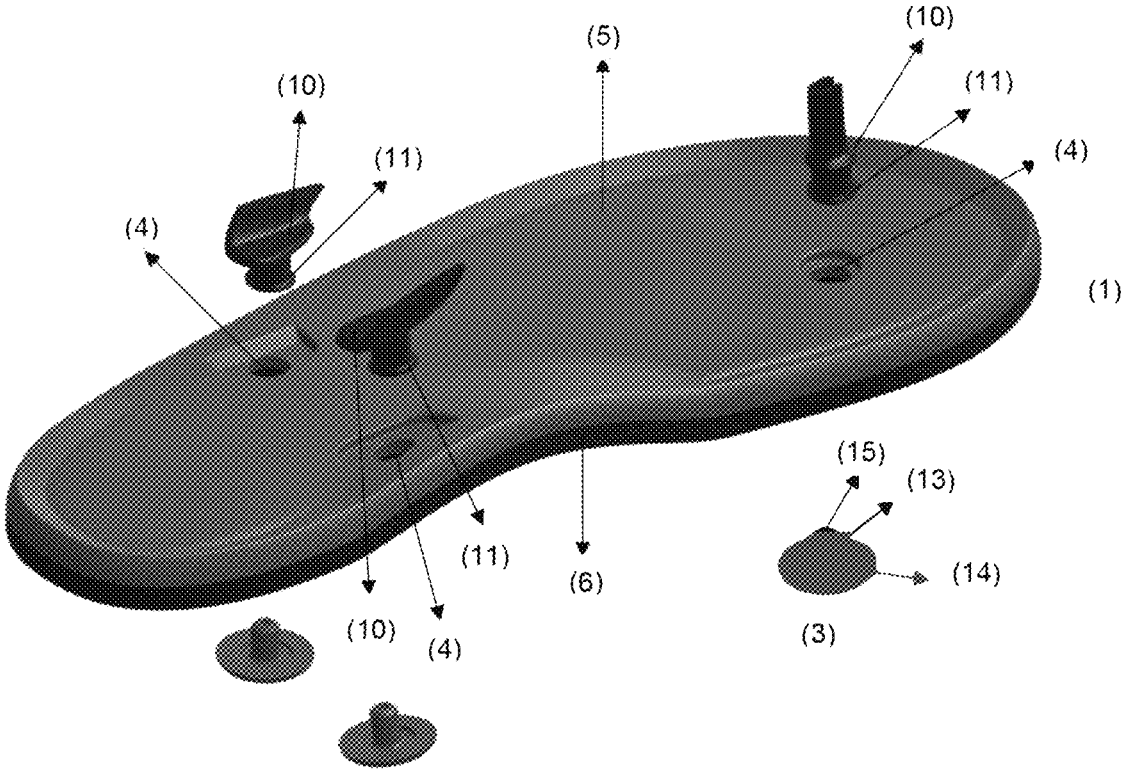
FIG. 13 is a top perspective view of the positioning of the attachment mechanism structures.

Also according to FIG. 1 and FIGS. 3 to 13, each of the cylindrical longitudinal straps (7, 8 and 9) of the upper (2) has two small protuberances (10 and 11), one in contact with the upper surface (5) of the flexible sole (1) and the user's feet, and another in contact with the lower surface (6) of the flexible sole (1) and the stopper (3) (FIG. 13). The longitudinal straps (7, 8 and 9) also have a hollow space (12) (FIG. 1) at their most distal ends, which pass through cavities (4) of the flexible sole (1) (FIG. 13) and fit tightly to the stoppers (3). The central longitudinal strap (7) part, located between the upper protuberance (10) and the lower protrusion (11), has a larger diameter than the rest of this strap, resulting in a firmer fit on the sole (1) (FIG. 1).

Figure 6:
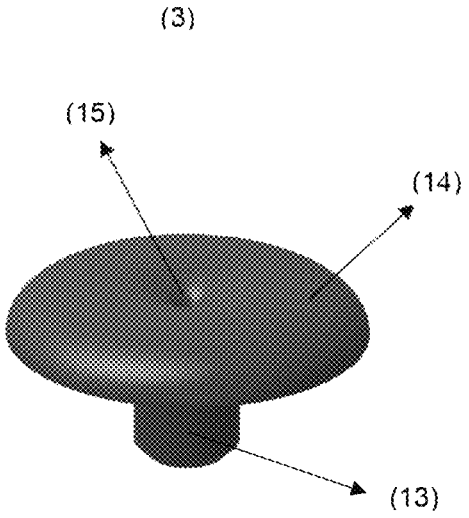
FIG. 6 is a top perspective view of the rigid plastic stopper.
Figure 7:
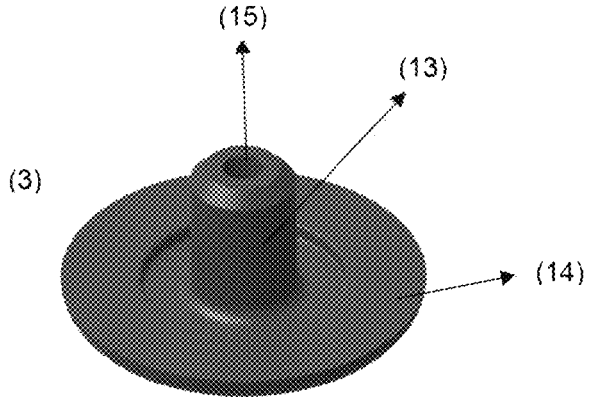
FIG. 7 is a bottom perspective view of the rigid plastic stopper.
Figure 8:
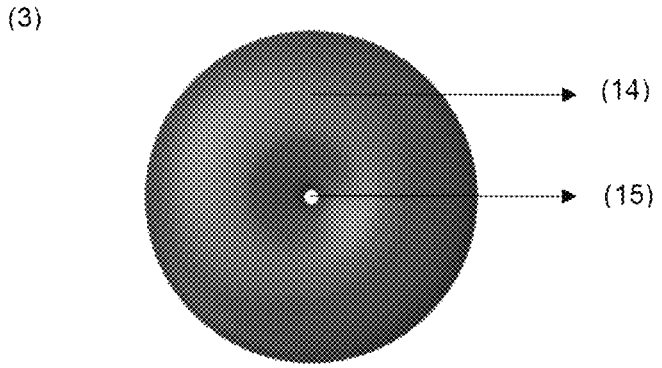
FIG. 8 is a top view of the rigid plastic stopper.
Figure 9:
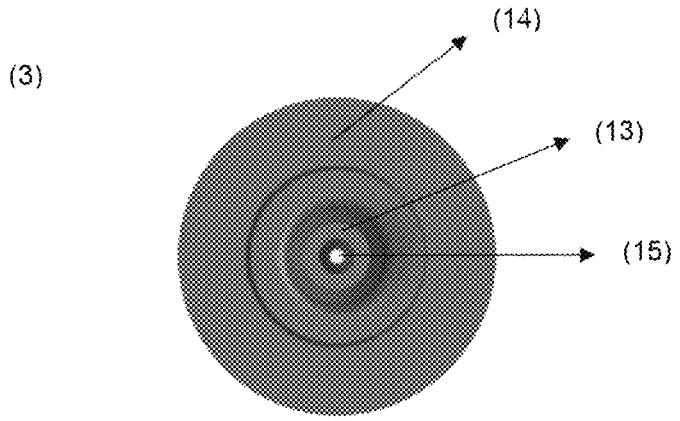
FIG. 9 is a bottom view of the rigid plastic stopper.
Figure 10:
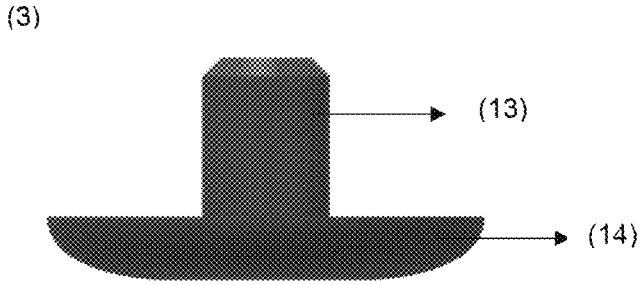
FIG. 10 is a side view of the rigid plastic stopper.
Figure 11:
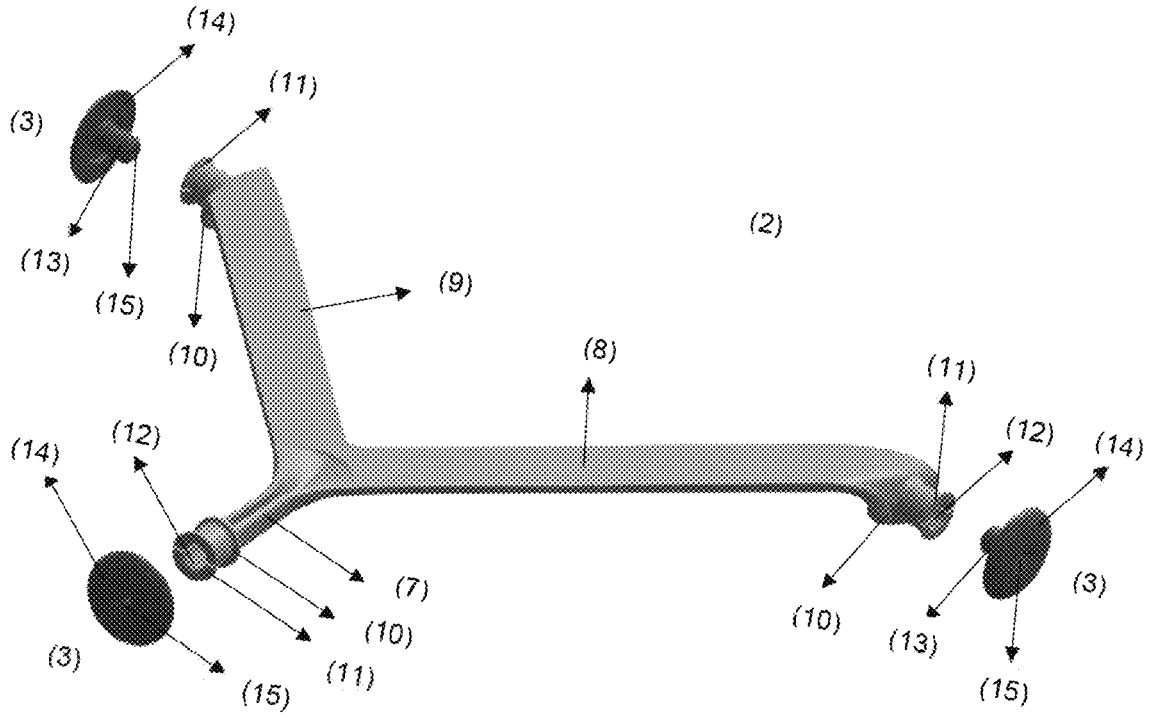
FIG. 11 is a bottom perspective view of the detached rigid plastic stopper and upper assembly.
Figure 12:
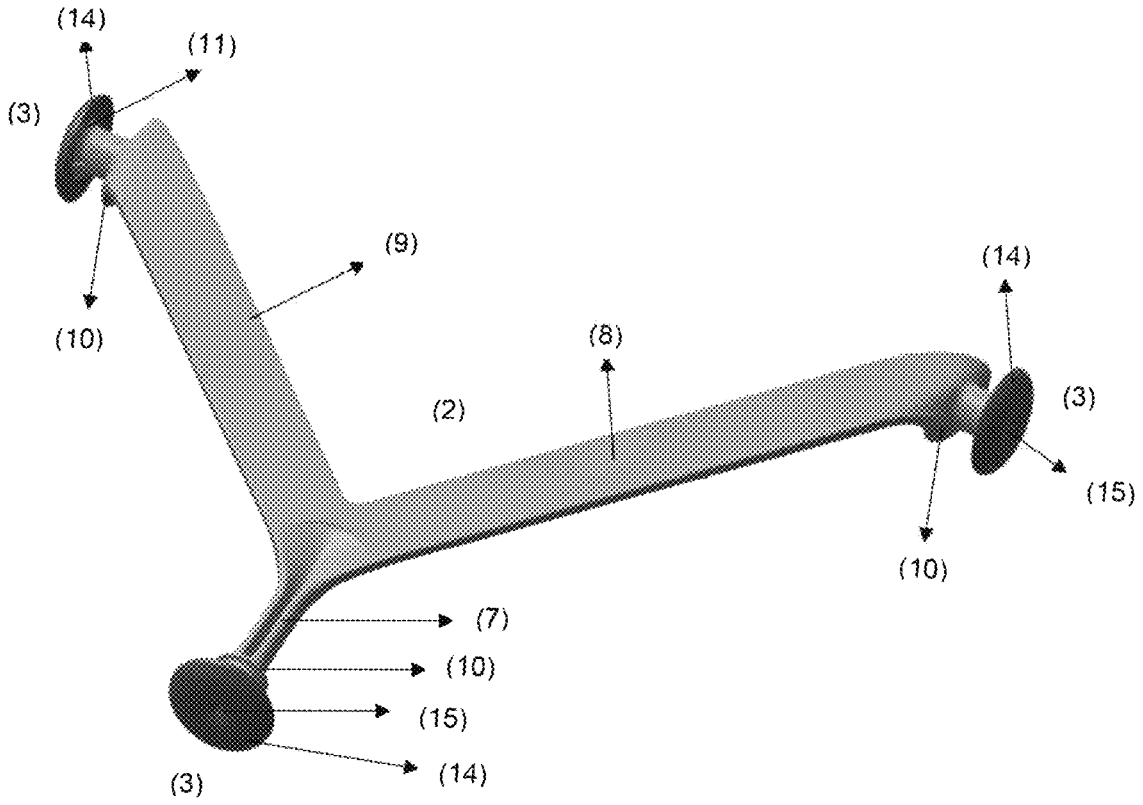
FIG. 12 is a bottom perspective view of the attached rigid plastic stopper and upper assembly.
Figure 14:
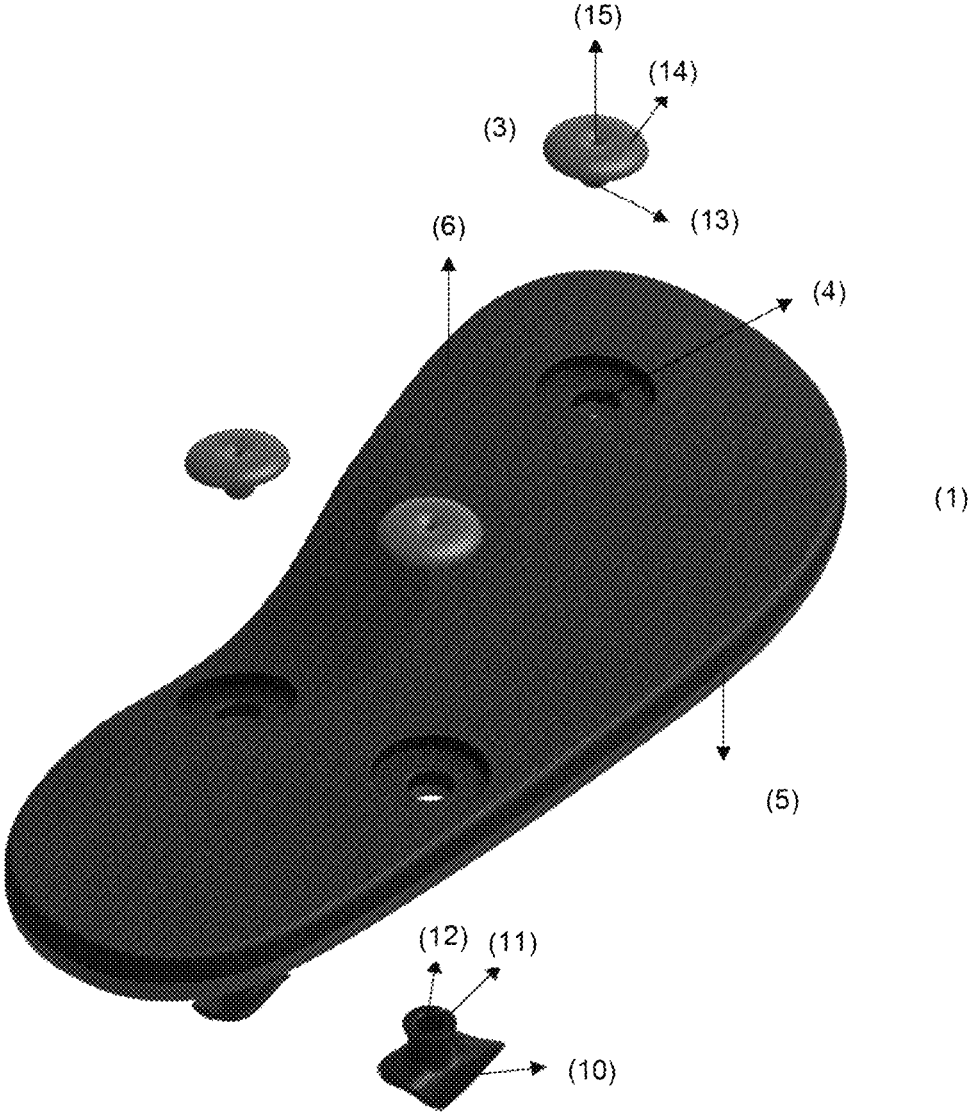
FIG. 14 is a bottom perspective view of the positioning of the attachment mechanism structures.

Also according to FIGS. 6, 11 and 14, the present utility model presents stoppers (3) made of rigid plastic, equipped with a smaller diameter region (13) (FIG. 6), which fits perfectly into the hollow space (12) of the distal ends of the upper (2) (FIG. 11), and a larger diameter region (14) that covers the lower protuberance (11) of the ends of the upper (2), and firmly attaches to the bottom part (6) of the sole (1) (FIG. 14). The stoppers (3) also have a central hole (15), which serves to escape the air inside the hollow spaces (12) of the upper (2) (FIG. 11), since the fit is tight.

It is possible to see (FIG. 12) the upper (2) with each of the longitudinal straps (7, 8, and 9) fitted with stoppers (3).

In FIGS. 13 and 14, on the other hand, all the component structures of the fitting mechanism proposed in the present utility model are observed, comprising: the ends of the upper (2) with the upper protuberance (10) and lower protuberance (11); the upper surface (5) and lower surface (6) of the sole (1), in addition to the cavities (4) of the sole (1); and the stoppers (3) comprising the region with the smallest diameter (13), the largest diameter (14) and the central hole (15). It is also possible to notice recesses in the sole (1) both on the upper surface (5) (FIG. 13) and on the lower surface (6) (FIG. 14). These recesses receive both the upper protuberance (10) and the larger diameter part (13) of the stopper (3), which covers the lower protuberance of the upper (2).

Figure 15:
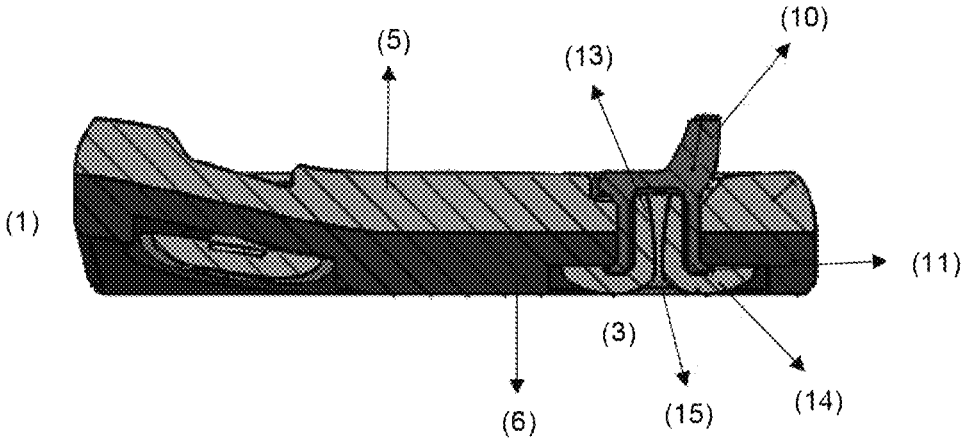
FIG. 15 is a cross-section side view of the attachment mechanism.

Finally, it is possible to see a detailed view of the fitting mechanism in FIG. 15, where the upper recess (10) of the upper (2) in contact with the upper surface (5) of the sole (1) and passing through the cavity is observed (4), where the lower protuberance (11) of the upper (2) attaches to the lower surface (6) of the sole (1). It is also possible to visualize the hollow space (12) of the upper (2), which receives the region with the smallest diameter (13) of the stopper (3), while the region with the largest diameter (14) of the stopper (3) covers the lower protuberance (11) of the upper (2), creating a hook mechanism. It is also possible to perceive the channel for the escape of air through the central hole (15) of the stopper (3), which escapes from the hollow space (12) of the upper (2) during the moment of fitting with the largest diameter region (14) the stopper (3).

The invention claimed is:

1. A structural arrangement of uppers on sandals, the arrangement comprising:

a flexible upper comprising a main longitudinal strap and two side longitudinal straps that extend from a first end of the main longitudinal strap, wherein each of the side longitudinal straps comprise, in distal regions, an upper protuberance which is in contact with an upper surface of a flexible sole, a lower protuberance which is in contact with the lower surface of the flexible sole, and wherein the lower protuberance defines a hollow space that passes through cavities in the flexible sole and receives, in its interior, a region with a smaller diameter of a rigid plastic stopper, said stopper having a region of larger diameter that overlies the lower protrusion of the most distal end of the upper, as well as a central hole which connects the inside of the hollow space to the outside environment.

2. The structural arrangement of claim 1 wherein the structural arrangement further comprises a first one and a second one of the rigid plastic stoppers that anchor the side longitudinal straps to the flexible sole, each being configured to be inserted, respectfully, into one of the lower protuberances at the distal ends of the two side longitudinal straps.

3. The structural arrangement of claim 1 wherein a second end of the main longitudinal strap comprises one of the upper protuberance and one of the lower protuberance that defines the hollow space.

4. The structural arrangement of claim 1, further comprising:

one of the rigid plastic stoppers designed to be inserted into the lower protuberance located at the second end of the main longitudinal strap.

5. The structural arrangement of claim 1, wherein the two side longitudinal straps are connected to the main longitudinal strap such that the flexible upper comprises a Y-shape structure made up of the two side longitudinal straps and the main longitudinal strap.

6. The structural arrangement of claim 1, wherein the flexible upper consists of the two side longitudinal straps and the main longitudinal strap.

7. The structural arrangement of claim 1, wherein the flexible upper is formed as a one-piece structure wherein the two side longitudinal straps are integrally formed with the main longitudinal strap.

8. The structural arrangement of claim 2 wherein a second end of the main longitudinal strap comprises one of the upper protuberance and one of the lower protuberance that defines the hollow space.

9. The structural arrangement of claim 2, wherein the lower protuberance at the distal end of the side longitudinal straps each comprise a flange that extends outwardly to mechanically engage a lower surface of the flexible sole; and wherein the first one and the second one of the rigid plastic stoppers each comprise: an upper cylindrical section corresponding to the region with the smaller diameter that are inserted into the hollow spaces of the lower protuberances; a middle cylindrical section also of the smaller diameter and serving to abut the inside surface of the lower protuberance so as to bias the flange of the lower protuberance into engagement with the lower surface of the flexible sole when the first one and the second one of the rigid plastic stoppers are inserted into the hollow spaces; and the region of larger diameter that covers the lower protuberance, which surround and rigidly contact the lower protuberance and the flange and thereby create a hook mechanism that secures the distal ends of the side longitudinal straps into the flexible sole.

10. The structural arrangement of claim 2, further comprising:

a third one of the rigid plastic stoppers, designed to be inserted into the lower protuberance located at the second end of the main longitudinal strap.

11. The structural arrangement of claim 3, further comprising:

a third one of the rigid plastic stoppers designed to be inserted into the lower protuberance located at the second end of the main longitudinal strap.

12. The structural arrangement of claim 11, wherein the two side longitudinal straps are connected to the main longitudinal strap such that the flexible upper comprises a Y-shape structure made up of the two side longitudinal straps and the main longitudinal strap.

13. The structural arrangement of claim 12, wherein the flexible upper consists of the two side longitudinal straps and the main longitudinal strap.

14. The structural arrangement of claim 13, wherein the flexible upper is formed as a one-piece structure wherein the two side longitudinal straps are integrally formed with the main longitudinal strap.

15. The structural arrangement of claim 3, wherein the lower protuberance at the distal end of the side longitudinal straps each comprise a flange that extends outwardly to mechanically engage a lower surface of the flexible sole; and wherein the first one and the second one of the rigid plastic stoppers each comprise: an upper cylindrical section corresponding to the region with the smaller diameter that are inserted into the hollow spaces of the lower protuberances; a middle cylindrical section also of the smaller diameter and serving to abut the inside surface of the lower protuberance so as to bias the flange of the lower protuberance into engagement with the lower surface of the flexible sole when the first one and the second one of the rigid plastic stoppers are inserted into the hollow spaces; and the region of larger diameter that covers the lower protuberance, which surround and rigidly contact the lower protuberance and the flange and thereby create a hook mechanism that secures the distal ends of the side longitudinal straps into the flexible sole.

16. The structural arrangement of claim 15, wherein the lower protuberance at a distal end of the main longitudinal strap comprises a flange that extends outwardly to mechanically engage a lower surface of the flexible sole; and wherein the third one of the rigid plastic stoppers comprised: an upper cylindrical section corresponding to the region with the smaller diameter that is inserted into the hollow space of the lower protuberance at a distal end of the main longitudinal strap; a middle cylindrical section also of the smaller diameter and serving to abut the inside surface of the lower protuberance at the distal end of the main longitudinal strap so as to bias the flange into engagement with the lower surface of the flexible sole when the third one of the rigid plastic stoppers is inserted into the hollow space at of the lower protuberance of the main longitudinal strap; and the region of larger diameter that covers the lower protuberance, wherein the middle cylindrical section and the region of larger diameter surround and rigidly contact the lower protuberance and the flange and thereby create a hook mechanism that secures the distal end of the main longitudinal strap into the flexible sole.

17. The structural arrangement of claim 15, wherein the two side longitudinal straps are connected to the main longitudinal strap such that the flexible upper comprises a Y-shape structure made up of the two side longitudinal straps and the main longitudinal strap.

18. The structural arrangement of claim 17, wherein the flexible upper consists of the two side longitudinal straps and the main longitudinal strap.

19. The structural arrangement of claim 18, wherein the flexible upper is formed as a one-piece structure wherein the two side longitudinal straps are integrally formed with the main longitudinal strap.

20. The structural arrangement of claim 19, wherein the lower protuberance at a distal end of the main longitudinal strap comprises a flange that extends outwardly to mechanically engage a lower surface of the flexible sole; and wherein the third one of the rigid plastic stoppers comprised: an upper cylindrical section corresponding to the region with the smaller diameter that is inserted into the hollow space of the lower protuberance at a distal end of the main longitudinal strap; a middle cylindrical section also of the smaller diameter and serving to abut the inside surface of the lower protuberance at the distal end of the main longitudinal strap so as to bias the flange into engagement with the lower surface of the flexible sole when the third one of the rigid plastic stoppers is inserted into the hollow space at of the lower protuberance of the main longitudinal strap; and the region of larger diameter that covers the lower protuberance, wherein the middle cylindrical section and the region of larger diameter surround and rigidly contact the lower protuberance and the flange and thereby create a hook mechanism that secures the distal end of the main longitudinal strap into the flexible sole.

* * * * *